US008201633B2

(12) United States Patent
Hilliard

(10) Patent No.: US 8,201,633 B2
(45) Date of Patent: Jun. 19, 2012

(54) SWITCHABLE CIRCULATING TOOL

(75) Inventor: Paul Hilliard, Edinburgh (GB)

(73) Assignee: WellTools Limited, Fife (GB)

( * ) Notice: Subject to any disclaimer, the term of this patent is extended or adjusted under 35 U.S.C. 154(b) by 250 days.

(21) Appl. No.: 12/673,742

(22) PCT Filed: Aug. 14, 2008

(86) PCT No.: PCT/GB2008/002742

§ 371 (c)(1),
(2), (4) Date: Feb. 16, 2010

(87) PCT Pub. No.: WO2009/024753

PCT Pub. Date: Feb. 26, 2009

(65) Prior Publication Data

US 2011/0120773 A1 May 26, 2011

(30) Foreign Application Priority Data

Aug. 17, 2007 (GB) ..... 0716049.2

(51) Int. Cl.
*E21B 33/00* (2006.01)

(52) U.S. Cl. ..... 166/332.8; 166/374; 166/386

(58) Field of Classification Search ..... 166/334.4, 166/332.8, 373, 383, 374, 386; 175/317
See application file for complete search history.

(56) References Cited

U.S. PATENT DOCUMENTS

| | | | | |
|---|---|---|---|---|
| 6,325,150 | B1 * | 12/2001 | Rayssiguier | 166/334.4 |
| 6,378,612 | B1 * | 4/2002 | Churchill | 166/319 |
| 2006/0011354 | A1 | 1/2006 | Logiudice et al. | |

FOREIGN PATENT DOCUMENTS

| | | | |
|---|---|---|---|
| EP | 1024249 | A2 | 8/2000 |
| GB | 688727 | A | 3/1953 |
| GB | 2309470 | A | 7/1997 |
| GB | 2351511 | A | 1/2001 |
| WO | WO 98/38410 | A1 | 9/1998 |
| WO | WO 2007/060449 | A2 | 5/2007 |
| WO | WO 2007060449 | A2 * | 5/2007 |

OTHER PUBLICATIONS

International Search Report for International Application No. PCT/GB2008/002742 (Feb. 2, 2009).

* cited by examiner

*Primary Examiner* — Kenneth L Thompson
*Assistant Examiner* — Ronald Runyan
(74) *Attorney, Agent, or Firm* — Jenkins, Wilson, Taylor & Hunt, P.A.

(57) ABSTRACT

A circulating tool for use in drilling a bore hole, the tool including a plurality of pistons which, by the activation of fluid pressure, move between a first configuration in which a side port of the tool is covered by a piston and a second configuration in which two adjacent pistons separate across the port to allow fluid to jet from the port. In the first configuration, the tool has a continuous cylindrical bore to allow the passage of other tools through the tool, while a flapper valve closes the bore in the second configuration to achieve maximum jetting of fluid from the tool. A third or intermediate configuration is also described so that the tool is operable to switch multiple times between the configurations via an indexing mechanism.

21 Claims, 4 Drawing Sheets

SWITCHABLE CIRCULATING TOOL

Figure 1A:
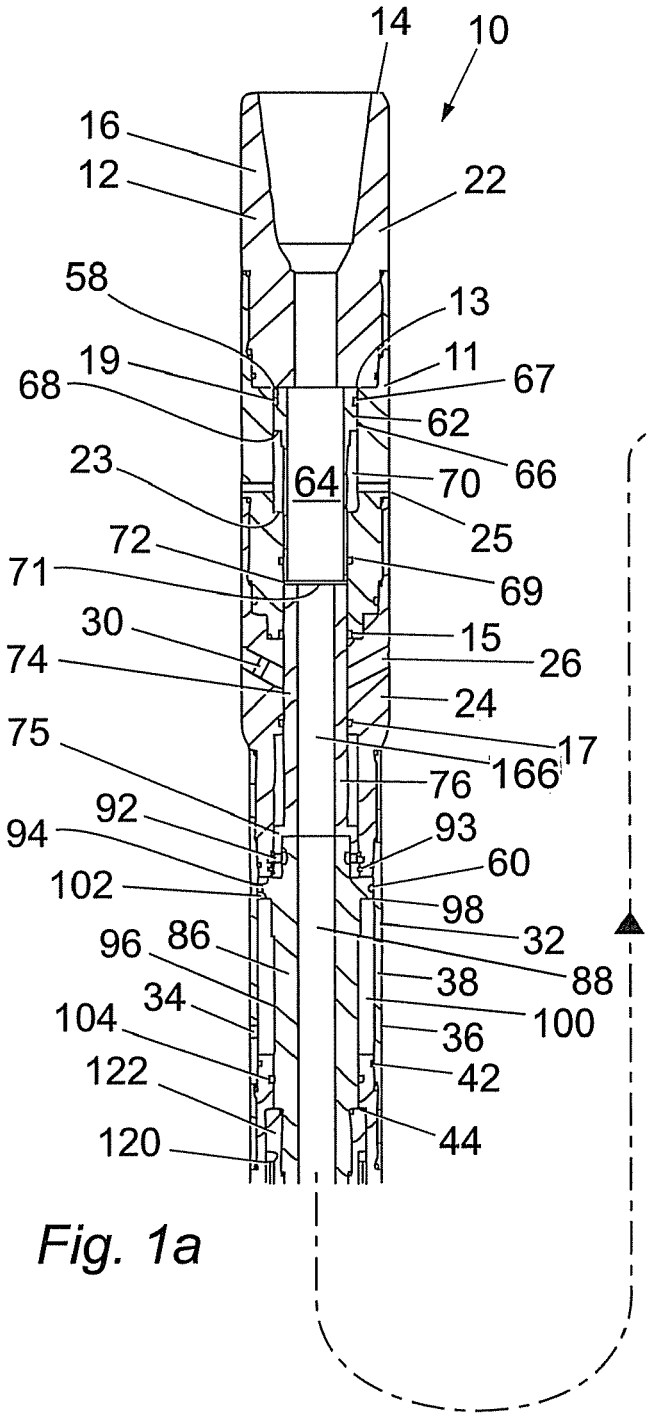

The present invention relates to a circulating tool for use in downhole operations in the oil and gas industry. More particularly, the invention relates to a pressure activated circulating tool having an open through bore which may be selectively sealed to allow fluid to be jetted from the tool for cleaning purposes and opened for the passage of fluid and drop balls to actuate tools such as pumps below, and allow logging equipment to be run through the tool.

In conventional drilling for oil and gas a drill string is run into a well bore. This is a length of tubing which has at its distal end, a drill bit. The depth of the well is increased by rotating the drill bit and bringing the resulting cuttings back to surface. The drill bit may be rotated by rotating the entire string from the surface or, particularly for extended reach wells, by incorporating a PDM (positive displacement motor) behind the drill bit. By using a PDM, driven by fluid passed through the drill string, this bottom hole assembly (BHA) can be run on coiled tubing. The principal advantage of coiled tubing is that it can be run in and pulled out of the hole at a faster pace than traditional work strings. Coiled tubing can also be run in live wells. This provides a significant time and cost saving during drilling as the string is pulled regularly to replace the drill bit and/or case the well to prevent it from collapsing.

The fluid used to drive the PDM is drilling fluid which serves the dual purpose of operating the motor and bringing the cuttings back to surface in the annulus between the drill string and the casing or well bore wall. However, it has been determined that the fluid flow rate required to operate a PDM is less than that required to effectively carry the drill uttings to surface.

To overcome this disadvantage, circulating subs have been developed to operate behind the PDM to control fluid flow rate at the motor and/or increase fluid flow rate to the annulus to improve the efficiency of cuttings removal.

The simplest of these circulating subs comprises a cylindrical body located in the string, the body having one or more radial ports to provide a passageway between a central throughbore and the annulus. Located in the body is a sleeve. The sleeve is attached to the body by a frangible element such as shear pin. In this configuration the radial ports are covered by the sleeve so all fluid in the central bore will pass directly through to the string below.

With the sleeve attached to the body, the sub is run into the wellbore behind the PDM. The PDM operates as required by passing fluid through the central bore. When additional pressure is required to remove cuttings to the surface, a ball is dropped through the bore of the string. The ball is sized to travel freely through the string but not the sleeve. Consequently the ball is stopped at the sleeve. As fluid is being pumped through the bore, a pressure differential is created across the ball which in turn causes the pin to shear. The sleeve then moves down the bore until it is arrested on a shoulder located on the inner wall of the bore. In this configuration the sleeve has dropped below the radial ports and all the fluid is jetted from the tool through the radial ports. Fluid flow rate can then be increased to improve the removal of cuttings.

The main disadvantage of this circulating sub is that it can only be operated once. When jetting begins, the motor is stopped as the central bore is sealed and fluid cannot pass to the PDM. If the PDM needs to be restarted, the entire string must be brought to the surface so that the ball can be removed and the sleeve repositioned with a replacement shear pin installed. This, of course, increases the time to drill the well and requires skilled personnel on the rig floor to reconfigure the sub when it is brought to the surface.

In order to overcome the disadvantage of these subs, deformable drop balls where used which seated against a spring loaded sleeve. A sufficient pressure differential across the ball succeeded in moving the sleeve axially downwards to clear the axial ports for jetting. In this configuration the pressure acted against the spring and movement of the sleeve cleared the radial ports for jetting of fluid. Further pressure was then applied via the fluid to cause the ball to deform and squeeze through the sleeve. The ball fell through the central bore and with the pressure differential removed, the sleeve moved back to its original position by virtue of the spring and covered the ports. The advantage of this sub was that it could be operated multiple times by merely dropping a deformable ball through the string when jetting was required.

However, these subs had major disadvantages. The drop balls which traveled through the bore below the sub had no exit path and consequently quickly blocked the bore. This severely limited the number of times the sub could be operated and prevented wireline logging and control tools being run below the sub. Additionally, fluid pressure at the BHA in extended reach wells is unpredictable due to the distances and pressure drops involved. Consequently it was difficult to control when jetting would stop and the ball would be expelled through the sleeve, especially due to the pressure drop created by opening the central bore to the annulus through the ports.

Due to the inherent disadvantages in using drop balls, circulating subs where developed which operated by creating a pressure differential across a piston. These tools are similar to the deformable drop ball arrangements, but instead of dropping a ball against a top edge or ball seat on the sleeve, a pressure differential is created across the sleeve. In this way increasing fluid flow rate through the sub causes the sleeve to act as a piston and travel through the bore. Typically these subs are used to prevent excess fluid pressure entering the PDM as the radial ports automatically open at a pressure predetermined by the biasing spring. The spring is set to compress at a pressure equal to the safe maximum fluid pressure which can operate the PDM.

The advantage of these subs is that they can be operated any number of times by increasing and decreasing the fluid flow rate. A disadvantage of these subs is, however, that in maintaining a through bore for operation of the PDM there is a limit to the fluid flow rate which can be achieved to jet the cuttings to the surface. A yet further disadvantage of these subs is that as the flow rate may be difficult to control at extended depths an operator will not be sure which position the sub is in and consequently cannot reliably initiate jetting if desired. Yet further, fluids such as acids cannot be jetted from the tool as they must also be carried detrimentally through the pump and into the lower bore.

In order to overcome some of the disadvantages of the previous sub, an indexing mechanism has been developed for use in subs where a sleeve moves axially relative to the outer cylindrical body, typically located on the string. Such an arrangement has been used in the circulating sub discussed above and is described in GB 2 309 470. The indexing mechanism is arranged between the sleeves i.e. the body and sleeve, to control the axial movement therebetween by providing a cam having a pin on the surface of one sleeve located in a circumferentially extending groove on the surface of the other sleeve, such that movement between the sleeves causes the pin to travel within the groove and thereby dictate the extent of axial movement between the sleeves and define the configurations.

Typically the groove describes a continuous 'W' profile so that, when the pin is located in an upper apex of the groove the sub is in a first configuration i.e. ports in each sleeve are aligned and jetting fluid is pumped out of the side jetting ports. Conversely when the pin is in the lower apex of the groove, the sub is in the second configuration i.e. ports misaligned and flow only through the central bore. The groove may further include axial extensions to define other configuration positions, if desired. While these arrangements provide improved control of the sub downhole and multi-cycle operation, this sub still has the disadvantage that insufficient fluid flow rate may be achievable for jetting which restricts efficiency of the cuttings removal process. Yet further, as two sets of ports must align and misalign, the seals between the sleeves at these locations wear easily and gaps which exist increase damage to the seals and around the ports through turbulence and erosion.

A circulating tool has been proposed which provides for selectively sealing the through bore so that maximum flow rate can be used for jetting to remove drill cuttings while allowing the sub to be operated a multiple number of times and so letting the motor be started and stopped without requiring the string to be pulled out of the hole. This tool is disclosed in GB 2 351 511. The tool includes an outer body member and an inner body member, each having one or more holes or ports, and a displacement mechanism in the form of a piston assembly and restrictor nozzle, for producing relative movement between the inner and outer body members between a first 'aligned' configuration, in which the holes are in fluid communication, to a second 'obturated' configuration, in which they are not in fluid communication. The sub includes the indexing mechanism described above for multi-cycle operation by varying the fluid pressure through the sub.

Arranged in the outer body member at a lower end, is a pack-off sealing element in the form of an upstanding pin arranged in the central bore of the tool. The pin is connected to the outer member by a radially extending plate through which by-pass apertures are located. With the inner body member in the second configuration fluid travels through the central bore, around the pin and through the by-pass apertures to reach the PDM. When the inner body member is in the first configuration the inner body member engages with the pin to seal the central bore and prevent the passage of fluid to the PDM. With the central bore sealed the fluid is all expelled through the ports for maximum efficiency of cuttings removal.

The major disadvantage of this sub is that the pin obstructs the central bore and thus prevents the passage of other tools through the sub e.g. drop balls and logging equipment.

A further disadvantage in all of the prior art circulating subs described above is that as the ports align, turbulent flow is created in the fluid due to the sudden radial flow path opened which increases in volume until the ports are aligned. This turbulent flow causes abrasion wear of the sleeves at the ports. Additionally, where seals are located around the ports, these seals suffer abrasion wear and potential loss by being sucked from their mountings.

A yet further disadvantage of some of the prior art subs is in the use of the indexing mechanism. Typically one of the sleeves of the mechanism is spring biased to preferentially return the sleeve to a first configuration when there is a drop in pressure. The spring is usually located in a chamber against the rotating sleeve. Consequently, an induced rotational spring load can cause the sleeve to unintentionally rotate backwards. If the groove is non-symmetrical, the operator will then not be aware of the correct configuration of the sub.

It is an object of the present invention to provide a circulating tool which obviates or mitigates at least some of the disadvantages of prior art circulating subs.

It is a further object of at least one embodiment of the present invention to provide a circulating tool which has an uninterrupted through bore to allow for the passage of drop balls to tools below and the passage of tools such as electric line logging equipment.

It is a yet further object of at least one embodiment of the present invention to provide a circulating tool which is designed to reduce turbulent flow at the ports and thereby reduce the associated abrasion wear.

It is a yet further object of at least one embodiment of the present invention to provide a multi-cycle circulating tool which includes an indexing mechanism where the induced rotational spring load is isolated from the inner sleeve of the cam.

According to a first aspect of the present invention there is provided a circulating tool for connection in a work string comprising a substantially cylindrical body having first and second ends adapted for connection in the work string and at least one port extending through a side wall of the body; a piston assembly located within the body comprising a plurality of pistons arranged axially in the body; the pistons operable by fluid pressure for movement in the body between at least a first configuration in which the at least one port is covered by a piston and fluid passes through the tool in a continuous substantially cylindrical bore between the first and second ends, and a second configuration in which a valve closes the bore and two adjacent pistons separate to create a void therebetween to at least partially uncover the at least one port so that fluid passes from the bore through the void and through the at least one port.

In this way, the tool provides an uninterrupted bore for the passage of drop balls or other tools through the circulation tool while allowing the bore to be sealed for maximum jetting of fluid from the tool.

It will be appreciated that the term 'work string' encompasses any tubular arrangement passed down a borehole such as a drilling string or completion string on a pipe or coiled tubing.

Preferably the tool includes an indexing mechanism which couples the piston assembly to the body to permit the assembly to be moved between the configurations and to maintain the assembly in a configuration.

In this way, the tool can be reset between configurations any number of times.

Preferably the indexing mechanism comprises a slot arranged on a first surface and a pin locatable in the slot, arranged on a second surface. In an embodiment, the slot is arranged on an outer surface of a cam piston and the pin is arranged in an inner surface of the body.

In this way, the slot can provide a continuous path so that the tool can multi-cycle through the configurations.

Preferably also the pin is biased in the slot via a spring arranged between the cam piston and the inner surface of the body. Advantageously a sleeve is arranged around a portion of the cam piston so that the cam piston may rotate relative to the sleeve and move together in a first axial direction, and wherein the spring is arranged between an end of the sleeve and a stop on the body.

In this way, rotation induced on the spring cannot act upon the cam piston which could otherwise cause the piston to rotate backwards. Backwards rotation of the piston could cause the tool to attempt to operate in a reverse sequence of configurations.

Preferably the valve is a flapper valve. Preferably the flapper has a curved lower surface. More preferably, there is a seat of substantially matching curvature below the valve. In this way when the valve is pushed into the seat, the surface mates with the seat, thereby causing a seal to prevent the passage of substantially all of the fluid passed the valve.

Preferably at least one chamber is arranged between a piston and the body. Preferably also the chamber is sealed from the central bore and includes a port through a side wall of the body. This chamber is used to create a pressure differential across the piston and thereby cause the piston to move axially within the body.

Advantageously also the piston which seals the at least one port is coupled to the valve to ensure that the opening and closing of the port(s) occurs with the closing and opening of the valve.

Preferably the at least one port includes a nozzle. In this way the fluid can be jetted from the tool to assist in the removal and transport of cutting to the surface. More preferably the nozzle is upwardly directed so that the fluid is routed into the direction of fluid flow in the annulus between the tool and the borehole wall.

In an embodiment the pistons may separate by a distance less than the diameter of the ports. The degree of separation may be controlled by a spring located in the body. This provides an automatic self regulating port opening system responsive to the flow rate through the body.

Preferably there is a third or intermediate configuration. The third configuration may also close the ports and open the central bore as in the first configuration. This configuration may be used when there is no or minimal fluid flow through the tool such as when the tool is run in the borehole (RIH). Advantageously this configuration may be used between the first and second configurations as by turning off the fluid pumps on the surface i.e. by reducing flow rate through the tool, this third configuration is selected.

According to a second aspect of the present invention there is provided a method of drilling a borehole, the method comprising the steps:

a) running a work string including a circulating tool according to the first aspect into a borehole;
b) increasing the flow rate through the tool to move the body and piston assembly to the first configuration;
c) operating a further tool located below the circulating tool;
d) rotating a drill bit to remove a portion of the borehole;
e) decreasing the flow rate through the tool to move the body and piston assembly to an intermediate configuration;
f) increasing the flow rate through the tool to move the body and piston assembly to the second configuration;
g) jetting fluid from the circulating tool into an annulus between the circulating tool and the borehole; are
h) repeating steps (e), (f) and (b) as required.

Preferably the further tool is a fluid operated motor. More preferably the further tool is a positive displacement motor. Alternatively the further tool may be a drop ball operated tool and the step includes dropping a ball through the string and the bore of the circulating tool. The further tool may be a tool suspended on a wireline such as a logging tool, sized to run through the bore of the circulating tool.

The method may further include the step of regulating the jetting of fluid from the tool. The step of regulating may be achieved by partially opening the ports. Further the tool may be self regulating so that the quantity of jetted fluid is proportional to the flow rate through the tool.

Preferably the flow rate is adjusted by using the pressure drop from tools below the circulating tool. Alternatively the flow rate is adjusted by using a specific 'Jetting Head' which has relatively small nozzles installed to generate the necessary restriction to create a pressure drop.

The work string may be a drill string. The work string may be coiled tubing.

Figure 1B:
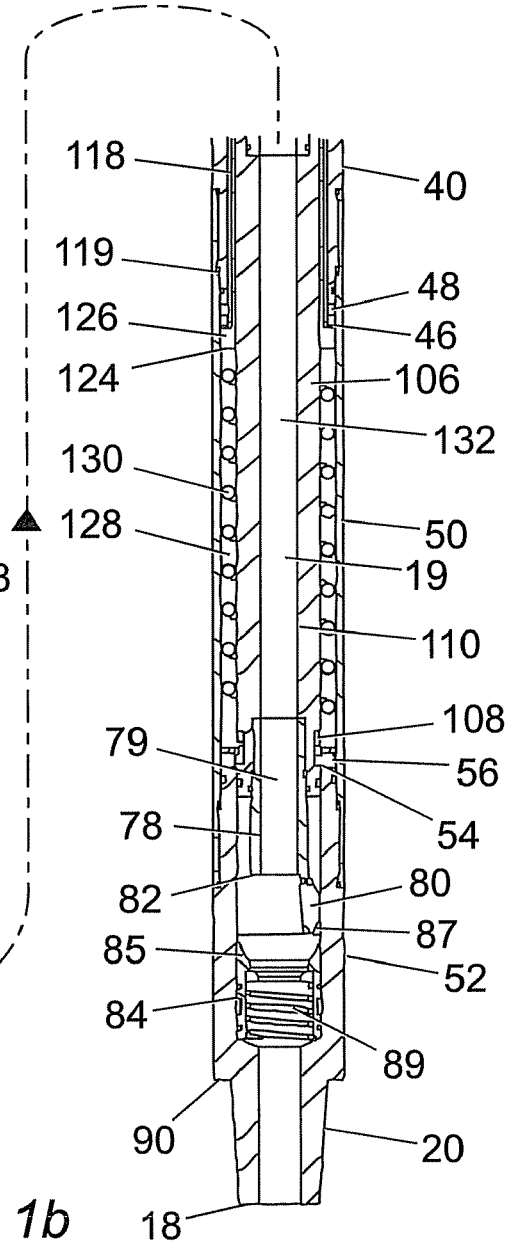
Figure 2:
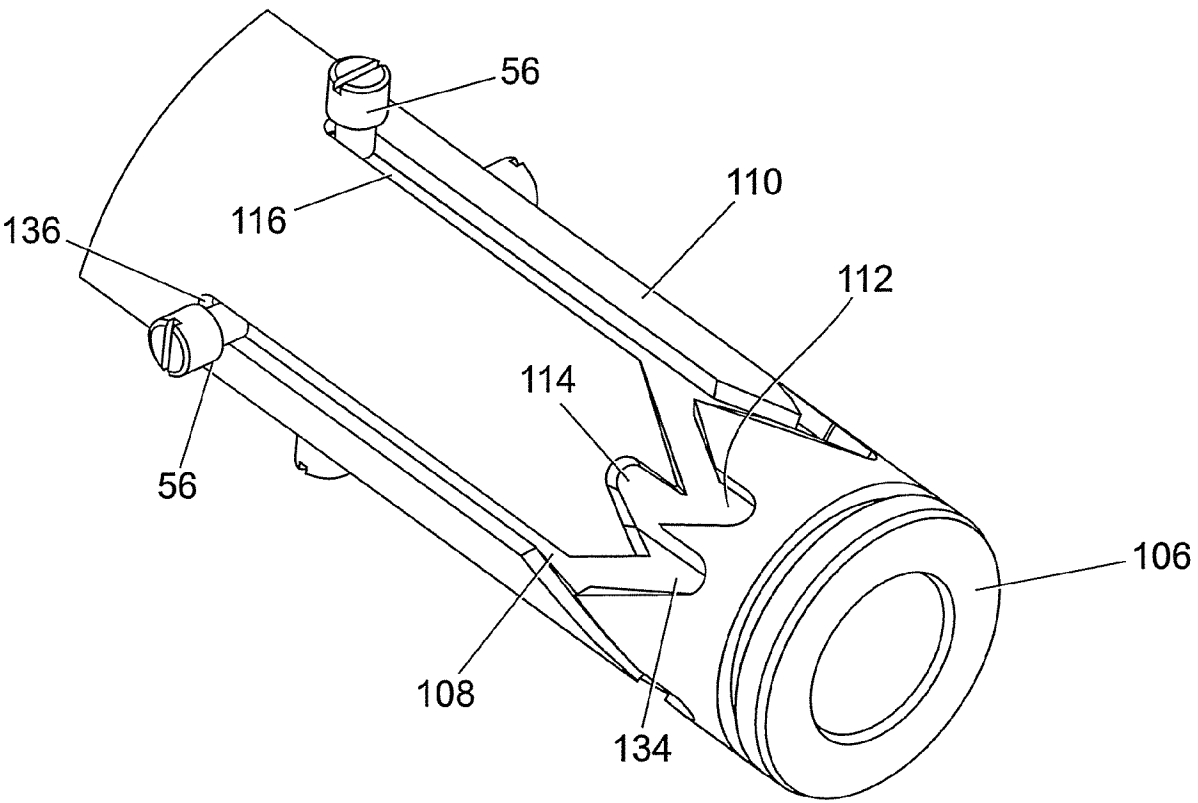

An embodiment of the present invention will now be described, by way of example only, with reference to the following drawings of which:

FIGS. 1*a* and 1*b* are cross-sectional views through a circulating tool in an intermediate configuration, according to an embodiment of the present invention;

FIG. 2 is a schematic illustration of the indexing mechanism of the tool of FIGS. 1*a* and 1*b;*

Figure 3A:
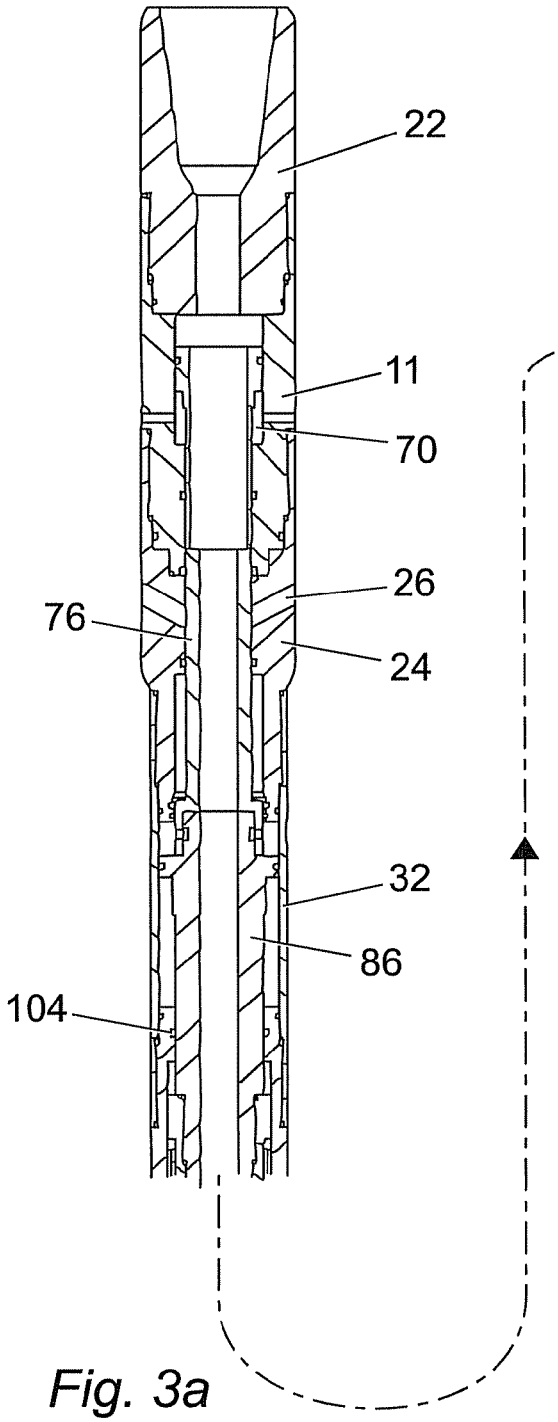
Figure 3B:
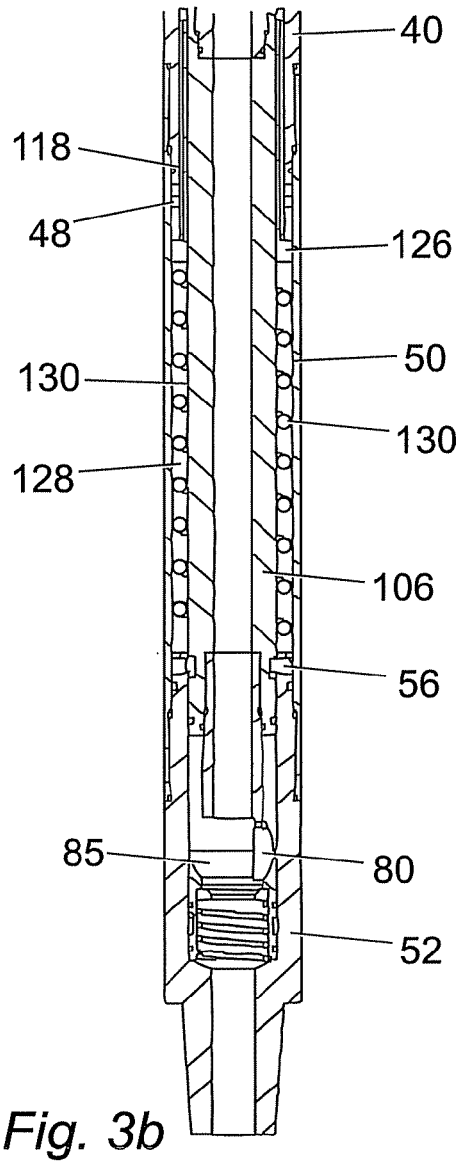
Figure 4A:
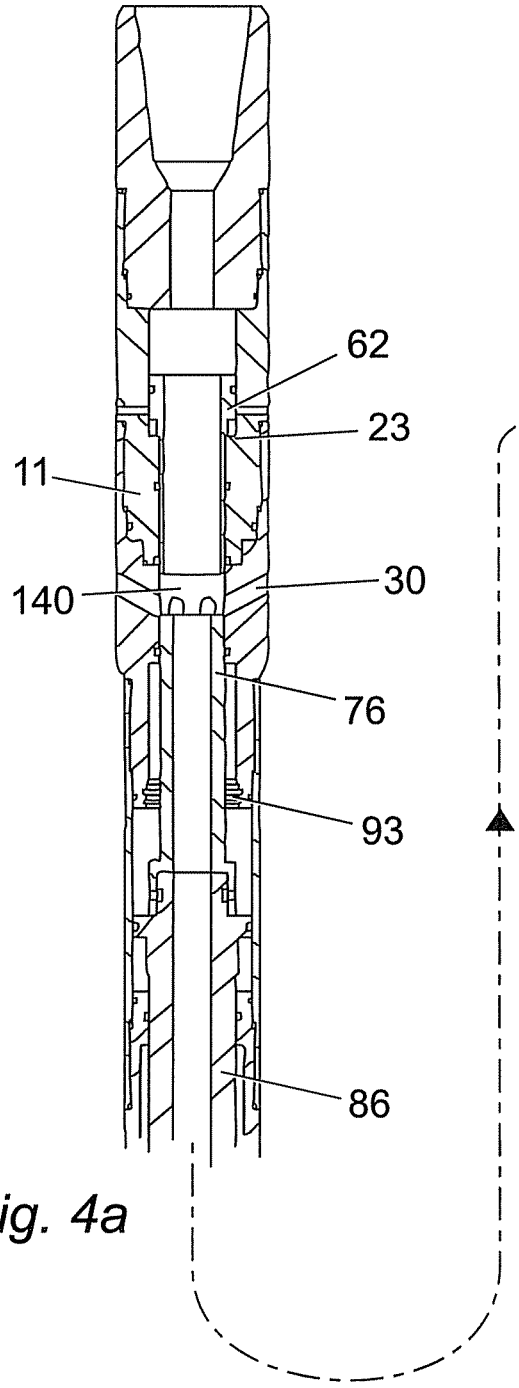
Figure 4B:
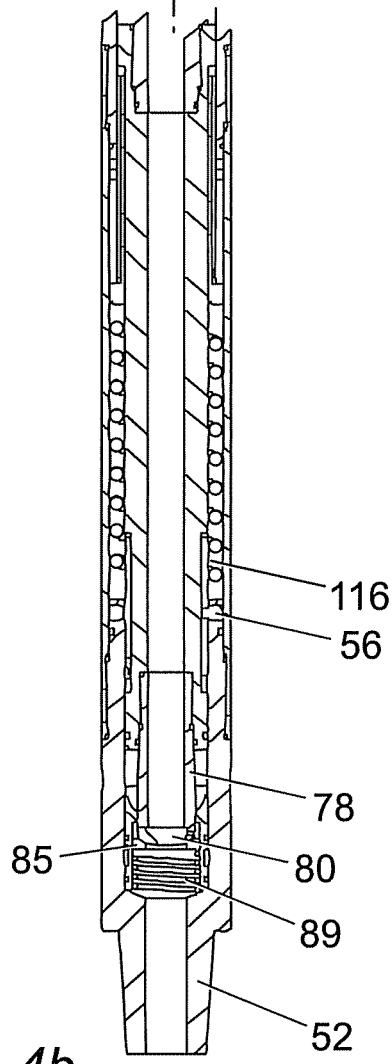

FIGS. 3*a* and 3*b* are cross-sectional views through the circulating tool of FIGS. 1*a* and 1*b*, in a first configuration; and FIGS. 4*a* and 4*b* are cross-sectional views through the circulating tool of FIGS. 1*a* and 1*b*, in a second configuration.

Referring initially to FIGS. 1*a* and 1*b* there is illustrated a circulating tool, generally indicated by reference numeral 10, according to an embodiment of the present invention. Tool 10 includes a cylindrical body 12 having an upper end 14 including a box section 16 for threaded engagement to a work string (not shown) above and a lower end 18 including a pin section 20 for threaded engagement to a work string (not shown) below. Body 12 comprises a number of cylindrical sections or subs which are screw threaded together to form one substantially cylindrical section having an inner bore 19.

In order from the upper end 14, a top sub 22 containing the box section 16 is connected to an exhaust sub 11. The top sub 22 includes a circumferential ledge 13 arranged perpendicularly to the bore 19. Arranged to abut the ledge 13 is a top ledge of the exhaust sub 11. Exhaust sub 11 has a further ledge 23 arranged below the top ledge 13. Additionally the exhaust sub 11 includes an aperture 25 located between an inner surface 38 and an outer surface 36 of the wall 28 of the body 12.

Arranged below the exhaust sub 11 and connected thereto is a jetting sub 24. The jetting sub 24 includes six ports 26 circumferentially arranged around the body 12 and extending through the wall 28 of the body 12. The ports 26 may include jetting nozzles 30 to increase the force with which fluid can be expelled through the nozzles 30. The ports 26 are also directed upwardly with respect to the bore 19.

The jetting sub 24 is connected to an upper sub 32. The upper sub 32 includes a circular array of relatively small apertures 34 around the body 12. Apertures 34 extend through the wall 28 of the body 12 to create a fluid passageway between the outer surface 36 and the inner surface 38 of the body 12. Below the upper sub 32 is a mid sub 40 which has an upper edge 42 forming a ledge perpendicular to and directed into the bore 19. Towards the upper edge 42 is an oppositely arranged ledge 44. Additionally the lower edge 46 of the mid sub 40 is also directed into the bore 19. A pin 48 also extends from the inner surface 38 at a lower end of the mid sub 40.

Under the mid sub 40 is a lower sub 50 which in turn is connected to a bottom sub 52 including the pin section 20. Bottom sub 52 is threaded into the lower sub 50 providing an upper ledge 54 extending perpendicularly into the bore 19. Arranged on the inner surface 38 of the bottom sub 52 is a circular array of torque pins 56 also directed into the bore 19. In this embodiment there are four torque pins 56 equidistantly arranged around the inner surface 38.

The body 12 is created in sub units 22, 11, 24, 32, 40, 50, 52 for ease of construction and to allow the inner piston assembly, generally indicted by reference numeral 60, to be located in the bore 19 and mate with sections of the inner surface 38.

Inner piston assembly 60 has at an upper end 58 an upper seal piston 62. Upper seal piston 62 has an inner bore 64 arranged axially through the piston 62, making the piston 62 sleeve like in appearance. On an outer surface 166 of the piston 62 is a circumferentially arranged ledge 68 which faces the ledge 23 of the exhaust sub 11. A first chamber 70 is formed by the ledges 23,68 together with the inner surface 38 of the body and the outer surface 166 of the piston 62. The aperture 25 is an exit port which connects the chamber 70 to the outer surface 36 of the body 12. The chamber 70 is sealed from the inner bore 64 by seals 67,69 arranged between the exhaust sub 11 and the upper seal piston 62.

Abutting the upper seal piston 62 at its lower edge 72, is the upper edge 71 of the lower seal piston 74. Piston 74 has a sleeve portion 76 including a bore 66 arranged axially through the piston 74. The lower end 75 is connected to a pressure piston 86 by pins 92.

Between the inner surface 38 of the body 12 and the seal piston 62,74 is arranged two circumferential seals 15,17 located on either side of the ports 26.

Pressure piston 86 has an inner bore 88 and a lower sleeve portion 90. It is also prevented from travelling above the jetting sub 24 by an abutment surface 94 formed as a ledge at the upper end of the piston 86 which contacts the lower edge the jetting sub 24.

On an outer surface 96 of the piston 86 is a circumferentially arranged ledge 98 which faces the ledge 42 of the mid sub 40. A second chamber 100 is formed by the ledges 42,98 together with the inner surface 38 of the body and the outer surface 96 of the piston 86. The apertures 34 are exit ports which connect the chamber 100 to the outer surface 36 of the body 12. The chamber 100 is sealed from the inner bore 88 by seals 102,104 arranged between the piston 86 and the inner surface 38 of the body 12.

The pressure piston 86 is coupled to the cam piston 106 arranged below. Coupling may be by screw thread or alternatively by bearings, as the cam piston 106 rotates in use. Rotation of the cam piston 106 is controlled by the torque pins 56 travelling in a groove 108 which is a machined profile on the outer surface 110 of the cam piston 106.

Reference is now made to FIG. 2 of the drawings which illustrates the portion of the cam piston 106 including the groove 108. Groove 108 is a continuous path around the outer surface 110 of the piston 106 generally in a 'W' or see-saw pattern. This forms a series of lower apexes 112 and upper apexes 114 sized to receive a torque pin 56 and by axial movement of the pin 56 cause the cam piston 106 to rotate. There are also extending portions 116 of the groove 108 at every second apex 114 providing an axial path over a distance of the piston 106.

Returning to FIGS. 1*a* and 1*b*, a sleeve 118 is located around an upper end of piston 106, being a close but sliding fit on the outer surface 110 of the cam piston 106. An upper edge 120 of the sleeve 118 abuts an overhang 122 of the cam piston 106 while the lower edge 124 provides a sleeve portion 126 slidingly engaged to both the outer surface 110 of the cam piston 106 and the inner surface 38 of the body 12. The sleeve 118 is only allowed to move axially by virtue of the pins 48 which engage in a longitudinal slot 119 in the outer surface of the sleeve 118.

The sleeve portion 126 also defines a third chamber 128 bounded by the sleeve portion 126 together with the inner surface 38, the outer surface 110 and the upper ledge 54 of the bottom sub 52. Located in the third chamber 128 is a bias spring 130 surrounding the cam piston 106 and biased against the sleeve 126. Cam piston 106 also has an internal cylindrical bore 132 arranged axially in the bore 19.

Connected to the cam piston 106 is a valve piston 78. Piston valve 78 has a cylindrical bore 79 located therethrough. At a lower end 82 of piston 78 there is located a flapper valve 80. The flapper valve 80 is arranged such that when it is open it lies clear of the bore 66. The flapper 80 is typically biased in the open configuration.

Located below the valve piston 78, located in the bore 66 of the bottom sub is a spring loaded seat, generally indicated by reference numeral 84. Seat 84 has an upwardly directed seating bed 85 whose radius of curvature matches a curvature on the lower surface 87 of the flapper 80. The bed 85 is supported on a spring 89 located in the seat 84 and can act against the spring 89. The spring 89 and the seat 84 are arrested in downward travel by abutment on a ledge 90 formed in the bottom sub 52.

It will be apparent that the piston bores 66, 88, 132, 79 all have the same diameter. Bore 64 is slightly greater in diameter but together bores 64, 66, 88, 132, 79 provide a single continuous bore 134 through the tool 10.

Further seals are also located between the body 12 and the piston 30 assembly 60 to prevent the egress of unwanted fluid between these parts. In use, tool 10 is assembled as described above with the bias spring 130 fully extended and the seat spring 89 also extended. In this arrangement the flapper 80 is in an open position sitting just above the seat bed 85. Additionally the seal pistons 62, 74 abut at the edges 71,72 and the upper sleeve 76 covers the ports 26. This is the configuration which the tool 10 will naturally rest in when located on a work string with little to no fluid flow present. This configuration is illustrated in FIGS. 1*a* and 1*b*.

The tool 10 is connected to a work string such as coiled tubing via the box section 16 and the pin section 20. The lower end 18 may be directly connected to a positive displacement motor (not shown) for driving a drill bit (not shown). The tool is run in hole (RIH) in this configuration and effectively acts as a continuous through bore 19. The inner piston assembly 60 does not move. The torque pins 56 are located in lower apexes 112 on the cam piston 106. Contact is also made between all the pistons.

When the drill bit has reached bottom hole and drilling needs to begin, drilling fluid sometimes referred to as a mud, is pumped from surface through the bore 19. As the flow rate through the tool 10 is increased a pressure drop is created between the bore 19 and an annulus between the body and the borehole wall.

This pressure drop also effects the chambers 70,100 as these are ported to the annulus. Consequentially the pressure differential acts to close the chambers 70,100 and thereby cause movement of the inner piston assembly 60. The piston assembly 60 moves axially downwards through the bore 19 compressing the bias spring 130. As the piston assembly 60 moves axially within the tool 10, the torque pins 56 force the cam piston 106 to rotate and consequently the entire assembly 60 rotates as they follow the groove 108. The torque pins are arrested when they reach the upper apexes 114. In this position the piston assembly stops. This is referred to as the first configuration or 'pump thru' mode and is illustrated in FIGS. 3*a* and 3*b* where like parts to those of FIGS. 1*a* and 1*b* have been given the same reference numeral to aid clarity. As long as the flow rate is maintained through the tool 10 the piston assembly 60 will remain in this position.

In the pump thru mode, fluid passes through the bore 19 to the PDM below. The PDM is thus kept operational and drilling takes place. As drilling occurs, cuttings are generated which are carried up the annulus back to surface. The fluid pressure through the motor has a maximum useable flow rate which must be monitored to prevent damage to the motor. Consequently there may be insufficient fluid pressure in the annulus to effectively bring ever increasing amounts of cuttings to the surface. In order to increase the flow rate in the annulus, the tool 10 is moved to the third or circulating configuration.

When required to switch to the third configuration the flow rate is first reduced which allows the bias spring 130 to extend, returning the piston assembly 60 to the RIH position i.e. the intermediate configuration as shown in FIGS. 1*a* and 1*b*. The torque pins 56 will travel further along the groove 108 in the same direction to fall into the adjacent lower apexes 134.

The flow rate through the tool 10 is once again increased resulting in an increase in the pressure drop acting on the chambers 70,100 as two differential piston areas. This internal pressure moves the inner piston assembly axially downwards within the bore 19 compressing the bias spring 130 as the sleeve 126 bears against the spring 130 under movement of the cam piston 106 via the action of the overhang 122 on the sleeve edge 120. As the inner piston assembly 60 moves axially within the tool 10, the torque pins 56 force the inner piston assembly 60 to rotate as it follows the groove 108 in the outer surface 110 of the cam piston 106. On this occasion the cam piston 106 is on the alternate stroke of the groove 108 and moves into the elongate slot 116 to travel towards a position at an end 136 thereof.

Reference is now made to FIGS. 4*a* and 4*b* of the drawings which illustrates the tool 10 in this third configuration. Like parts to those of FIGS. 1*a* and 1*b* have been given the same reference numerals to aid interpretation. The pressure differential in the chambers 70, 100 causes the upper seal piston 62 to move downwards as the ledge 68 of the seal piston 62 moves towards and meets the ledge 23 of the top sub 11. Chamber 70 is thus closed as pressure exits the port 25. At chamber 100, the exit of fluid through the apertures 34 in response to the pressure differential causes the ledge 98 of pressure piston 86 to move towards the upper edge 42 of mid sub 40.

Movement of the pressure piston 86 shifts the cam piston 106 and consequently the valve piston 78. As the valve piston 78 moves downwards, the lower surface 87 of the flapper 80 is guided over the surface of the bed 85 to bring the flapper 80 into a horizontal configuration. This arrangement seals the bore 79 as the upper surface of the flapper 80 is held against the lower end 82 of the valve piston 78. Further pressure causes the flapper 80 to force against the bed 85 and compress the spring 89. Such force from the spring 89 assists in maintaining the valve 80 in the closed position sealing the through bore. Consequently no fluid can pass this point of the bore 78.

As the chamber 70 empties, this causes the upper seal piston 62 to move axially downwards against the lower seal piston 74. These seal pistons 62,74 move as a single piston until ledge 68 is stopped at ledge 23 of the exhaust sub 11. However, the pull from the pressure piston 86 upon the lower seal piston 74 causes the seal piston 62,74 to separate at the abutment surfaces 71,72 to create a void 140 therebetween.

This configuration is known as the circulating mode. This is because all the fluid entering the tool 10 at the top sub 22 is directed radially outwardly from the bore 19 via ports 26. If nozzles 30 are present in the ports 26 the effect is to jet fluid into the annulus in the direction of fluid and cutting flow. This increases the flow rate in the annulus and assists in bringing the cuttings to surface. Again, maintaining the flow through the tool 10 will keep the inner piston assembly 60 in this position.

Additionally by creating a void 140 rather than aligning a further set of ports with the radial ports 26, the flow at the ports is less turbulent as there is a direct exit path.

It will be appreciated that when the torque pin 56 is in the elongate slot 116 the pistons 62,74 will begin to separate and fluid is circulated to the annulus. The length of travel in the slot 116 will determine the degree of opening of the pistons 62, 74 and consequently the size of the void 140. This in turn provides a gradual uncovering of the ports 30 as the piston 74 moves downwards. FIGS. 4*a* and 4*b* illustrate the pin 56 at a midpoint in the slot 116 and the ports 30 are partially uncovered. Such partial opening of the ports 30 still provides enhanced flow capability.

Movement of the pin 56 in the slot 116 is determined by the flow rate through the tool. Once the flapper 80 is closed the flow rate acts against the spring 89. The load on the spring determines the degree of opening of the ports 30. Thus from a partially uncovered position, if a further increase in the flow rate is required the piston 78 will travel further down and open up the circulating ports even more. This allows the flow rate of jetting to be increased without an observed increase in pressure drop at the surface of the well. Consequently the tool advantageously automatically regulates itself to open and close as much as required, as long as the resultant pressure is sufficient to overcome the spring load 89.

If drilling is to be continued the flow rate is reduced to zero to initially return the tool 10 to the intermediate configuration, FIGS. 1*a* and 1*b*. The torque pins 56 move the piston assembly 60 to locate the pins 56 in a lower apex 112. Flow rate is increased again and the tool 10 will move to the first configuration (FIGS. 3*a* and 3*b*) as described hereinbefore.

As the groove 108 is cyclic it will be appreciated that the tool can be switched between the pump thru' and circulation modes as many times as required by merely changing the flow induced pressure in the tool 10.

The principal advantage of the present invention is that it provides a pressure activated circulating tool operable to switch multiple times between a pump thru' mode and a circulation mode which, in the pump thru mode has an uninterrupted through bore to allow for the passage of drop balls to tools below and the passage of other tools such as electric line logging equipment.

A further advantage of at least one embodiment of the present invention is that it provides a circulating tool which includes a split piston to reduce turbulent flow at the ports and thereby reduce the associated abrasion wear.

A yet further advantage of at least one embodiment of the present invention is that it provides a multi-cycle circulating tool which includes an indexing mechanism where the induced rotational spring load is isolated from the inner sleeve of the cam.

Various modifications may be made to the invention herein described without departing from the scope thereof. For example, additional jetting ports may be added to a lower end of the tool so that jetting can be achieved as the tool is run in the borehole. Further the numbers of ports and apertures may be varied to suit the environment and the dimensions of pistons within the tool. The flapper valve may be replaced with any suitable one-way valve which is actuable from a sleeve.

What is claimed is:

1. A circulating tool for connection in a work string comprising a substantially cylindrical body having first and second ends adapted for connection in the work string and at least one port extending through a side wall of the body and a continuous substantially cylindrical bore between the first and second ends;

a piston assembly located within the body comprising a plurality of pistons arranged axially in the body;

the pistons operable by a differential fluid pressure caused by fluid pumped from surface creating a pressure drop between fluid in the bore and the pressure of fluid located in an annulus surrounding the circulating tool, the differential fluid pressure causing movement of the pistons in the body between at least a first configuration in which the at least one port is covered by a piston and fluid passes through the tool in the continuous substantially cylindrical bore between the first and second ends, and a second configuration in which a valve closes the bore and two adjacent pistons separate to create a void therebetween to at least partially uncover the at least one port so that fluid passes from the bore through the void and through the at least one port.

2. A circulating tool according to claim 1, wherein the pistons are operable by a differential fluid pressure created wholly by fluid pumped from surface through the bore and without requiring an object to be dropped into the bore from surface.

3. A circulating tool according to claim 1, wherein a circumferential seal is located on each side of the at least one port wherein at least one of the pistons cover each of the said seals when the tool is in the first and second configurations and moves between the first and second configurations.

4. A circulating tool according to claim 1 wherein the tool includes an indexing mechanism which couples the piston assembly to the body to permit the assembly to be moved between the configurations and to maintain the assembly in a configuration;

wherein the indexing mechanism comprises a slot arranged on a first surface and a pin locatable in the slot, arranged on a second surface;

wherein the slot is arranged on an outer surface of a cam piston and the pin is arranged in an inner surface of the body.

5. A circulating tool according to claim 4 wherein the pin is biased in the slot via a spring arranged between the cam piston and the inner surface of the body, and wherein a sleeve is arranged around a portion of the cam piston so that the cam piston can rotate relative to the sleeve and move together in a first axial direction, and wherein the spring is arranged between an end of the sleeve and a stop on the body.

6. A circulating tool according to claim 1 wherein the valve is a flapper valve which has a curved lower surface, and the tool includes a seat of substantially matching curvature below the flapper valve.

7. A circulating tool according to claim 1 wherein at least one chamber is arranged between a piston and the body wherein the chamber is sealed from the central bore and includes a port through a side wall of the body, wherein the differential fluid pressure acts to close the at least one chamber and thereby causes said movement of the pistons in the body between at least the first configuration and the second configuration.

8. A circulating tool according to claim 1 wherein the piston which seals the at least one port is permanently coupled to the valve to thereby ensure that the opening and closing of the port(s) occurs with the closing and opening of the valve.

9. A circulating tool according to claim 1 wherein the at least one port includes a nozzle which is upwardly directed so that the fluid is routed into a direction of fluid flow in an annulus between the tool and a borehole wall.

10. A circulating tool according to claim 1 wherein the pistons separate by a distance less than a diameter of the ports, and the separation distance is controlled by a spring located in the body.

11. A circulating tool according to claim 1 wherein there is a third configuration which closes the ports and opens the central bore as in the first configuration.

12. A method of drilling a borehole, the method comprising the steps:

a) running a work string including a circulating tool according to claim 1;

b) increasing the flow rate through the tool to move the body and piston assembly to the first configuration;

c) operating a further tool located below the circulating tool;

d) rotating a drill bit to remove a portion of the borehole;

e) decreasing the flow rate through the tool to move the body and piston assembly to an intermediate configuration;

f) increasing the flow rate through the tool to move the body and piston assembly to the second configuration;

g) jetting fluid from the circulating tool into an annulus between the circulating tool and the borehole; and h) repeating steps (e), (f) and (g).

13. A method of drilling a borehole according to claim 12 wherein the further tool is a fluid operated motor.

14. A method of drilling a borehole according to claim 12 wherein the further tool is a drop ball operated tool and step (c) includes dropping a ball through the string and the bore of the circulating tool such that it passes therethrough and arrives at the further tool downstream of the circulating tool.

15. A method of drilling a borehole according to claim 12 wherein the further tool is a tool suspended on a wireline sized to run through the bore of the circulating tool.

16. A method of drilling a borehole according to claim 12 wherein the method further includes the step of regulating the jetting of fluid from the tool by partially opening the ports.

17. A method of drilling a borehole according to claim 12 wherein the tool is self-regulating in that the quantity of jetted fluid is proportional to the flow rate through the tool.

18. A method of drilling a borehole according to claim 12 wherein the flow rate is adjusted by using a pressure drop from one or more tools located below the circulating tool.

19. A method of drilling a borehole according to claim 12 wherein the flow rate is adjusted by including a jetting head having relatively small nozzles installed to generate the necessary restriction to create a pressure drop.

20. A method of drilling a borehole according to claim 12 wherein the work string is a drill string.

21. A method of drilling a borehole according to claim 12 wherein the work string is coiled tubing.

* * * * *